US005284241A

United States Patent [19]

Winton et al.

[11] Patent Number: 5,284,241

[45] Date of Patent: Feb. 8, 1994

[54] COMMUTATOR HANDLING APPARATUS

[75] Inventors: W. Patrick Winton; Alvin C. Banner, both of Montgomery County, Ohio

[73] Assignee: Globe Products Inc., Huber Heights, Ohio

[21] Appl. No.: 989,200

[22] Filed: Dec. 11, 1992

Related U.S. Application Data

[62] Division of Ser. No. 675,630, Mar. 25, 1991, Pat. No. 5,170,553.

[51] Int. Cl.[5] ..... B65D 85/42

[52] U.S. Cl. ..... 206/303; 29/597; 29/733; 206/328; 206/499; 229/4.5

[58] Field of Search ..... 29/597, 598, 733, 732, 29/734, 759; 206/303, 328, 334, 499; 229/4.5; 220/669, 675

[56] References Cited

U.S. PATENT DOCUMENTS

| | | | |
|---|---|---|---|
| 3,579,771 | 5/1971 | Schuette et al. | 29/33 |
| 3,624,890 | 12/1971 | Schuette et al. | 29/205 |
| 4,012,834 | 3/1977 | LeVasseur | 29/733 X |
| 4,577,399 | 3/1986 | Ott | 29/733 |
| 4,815,594 | 3/1989 | Olson | 206/328 |
| 4,945,631 | 8/1990 | Banner et al. | 29/705 |
| 4,956,910 | 9/1990 | Banner et al. | 29/593 |

*Primary Examiner*—Carl E. Hall

*Attorney, Agent, or Firm*—Roger S. Dybvig

[57] ABSTRACT

A plurality of commutators are inserted into a commutator supply tube in end-to-end, tang-oriented relationship to form a row of commutators mutually aligned along a common axis. The ends of the supply tube may be at least partly covered during transport and handling. The commutator-filled tube is oriented on a horizontal axis in axial alignment with a commutator-receiving nest. A first commutator in the tube is inserted into the nest by pushing on the opposite end of the row. The nest is moved into alignment with a placing ram and the commutator pushed into the ram nosepiece after which the ram is operated to press the commutator onto an armature shaft. The process is repeatedly carried out until all of the commutators are removed from the tube. The process may also include a commutator tang forming step and a tang ejection capability. An empty tube is replaced successively by other tubes filled with commutators so that the process can be repeatedly carried out over an indefinite period of time. An intermittently-operated conveyor having tube-receiving seats is used to convey the tubes to the area of the commutator placing machine.

A commutator feed plate having plural commutator-receiving nests is provided that intermittently rotates through a limited angle about a horizontal axis to successively move the nests from station-to-station. Open windows in the feed plate provide space for operation of the ram.

10 Claims, 4 Drawing Sheets 46
40
44
46

46
34
20
22
24
42
42
40
44
46

40
42
20
22
34
42
42

22
46
20
4
4
24
42
20
44
40
46

COMMUTATOR HANDLING APPARATUS

This is a divisional of copending application Ser. No. 07,675,630 filed on Mar. 25, 1991, now U.S. Pat. No. 5,170,553.

SUMMARY OF THE INVENTION

This invention relates to a commutator handling and placing method and apparatus for use in the manufacture of armatures for electric motors.

"Commutator placing" refers to an electric motor assembly operation by which a commutator is pressed onto an armature shaft in a predetermined angular orientation relative to an armature core that has previously been assembled onto the shaft. Examples of commutator placing methods and apparatus are disclosed in U.S. Pat. No. 4,945,631 of Banner et al, granted Aug. 7, 1990, the disclosure of which is hereby incorporated by reference herein.

As discussed in the Banner et al '631 patent, prior to the actual pressing of a commutator onto an armature shaft, the commutator is positioned in axial alignment with the armature shaft with the armature core and the commutator appropriately angularly oriented relative to one another about the axis of alignment of the armature shaft and the commutator. A common practice, illustrated in the '631 patent, used with commutators having bars with coil lead-receiving hooks or tangs, is to angularly align the commutator tangs with the slots of the armature core, locate the commutator thus aligned in a ram nosepiece, and operate the ram to press the commutator onto the armature shaft. In some cases, also described in said Banner et al '631 patent, a more precise alignment may be obtained by angularly aligning the edges of the commutator bars with the armature core slots—but this is done after the commutator tangs are first angularly oriented relative to the core slots.

Various methods have been used to feed commutators to commutator placing machines but none of the known methods is entirely satisfactory. Commutators may be automatically fed by a vibratory bowl which aligns the commutators and directs them to a supply chute. Vibratory bowls are often inefficient because the commutators may be damaged from bumping against one another and the tangs of the commutators sometimes become stuck together.

An object of this invention is to provide an improved method and apparatus for handling and placing commutators. More particularly, it is an object of this invention to provide a method and apparatus for more efficiently delivering commutators from a supply of commutators to the ram nosepiece of a commutator placing machine with the commutators in proper angular and axial alignment.

A commutator handling and placing method in accordance with this invention comprises the steps of inserting a plurality of commutators into a commutator supply tube in end-to end, tang-oriented relationship to form a row of commutators mutually aligned along a common axis, orienting the tube on a horizontal axis in axial alignment with a commutator-receiving nest, transferring a first commutator from one end of the row of commutators in the tube by pushing on the opposite end of the row, moving the nest into alignment with a ram nosepiece, pushing the commutator into the ram nosepiece, removing the nest from alignment with the ram nosepiece, and pressing the commutator onto an armature shaft by movement of the ram nosepiece. The process is repeatedly carried out until all of the commutators are removed from the tube. Preferably, the process also includes a commutator tang forming step accomplished on each commutator after it is inserted into its nest and before it is transferred to the ram nosepiece. If the commutator is defective so that the forming step cannot be successfully completed, the commutator is ejected from its nest before it reaches a position of alignment with the ram nosepiece.

The empty tube is replaced successively by other tubes filled with commutators so that the process can be repeatedly carried out over an indefinite period of time. An intermittently-operated conveyor having tube-receiving seats is preferably used to convey the tubes to the area of the commutator placing machine. Tang-orientation of the commutators in the tubes is preferably obtained by forming the tubes with longitudinally-extending ribs or keys on their inner surfaces that snugly fit between adjacent commutator tangs.

Proper orientation of the tubes relative to the commutator-receiving nests can be provided by interfitting surfaces on the tubes and the seats. The angular orientation is readily maintained when the commutators are placed into the nests and, after that, into the ram nosepiece by the manner in which the nests are moved. No further tang-orienting steps are required (unless the commutator is edge oriented after its insertion into the ram nosepiece).

This method enables a business arrangement wherein either a manufacturer of commutators or a manufacturer of armatures inserts the commutators into the tubes after inspection of the commutators. The tubes can then be used for shipping or other transport and for storage.

A commutator feed plate having plural commutator-receiving nests is preferably provided that intermittently rotates through a limited angle about a horizontal axis to successively move the nests from station-to-station. The orientations of the nests and the feed plate are uniformly the same so that they are in predetermined orientations after each rotation of the feed plate.

Other objects and advantages will become apparent from the following description and the drawings.

DETAILED DESCRIPTION

Figures 1, 2, 3, 4:
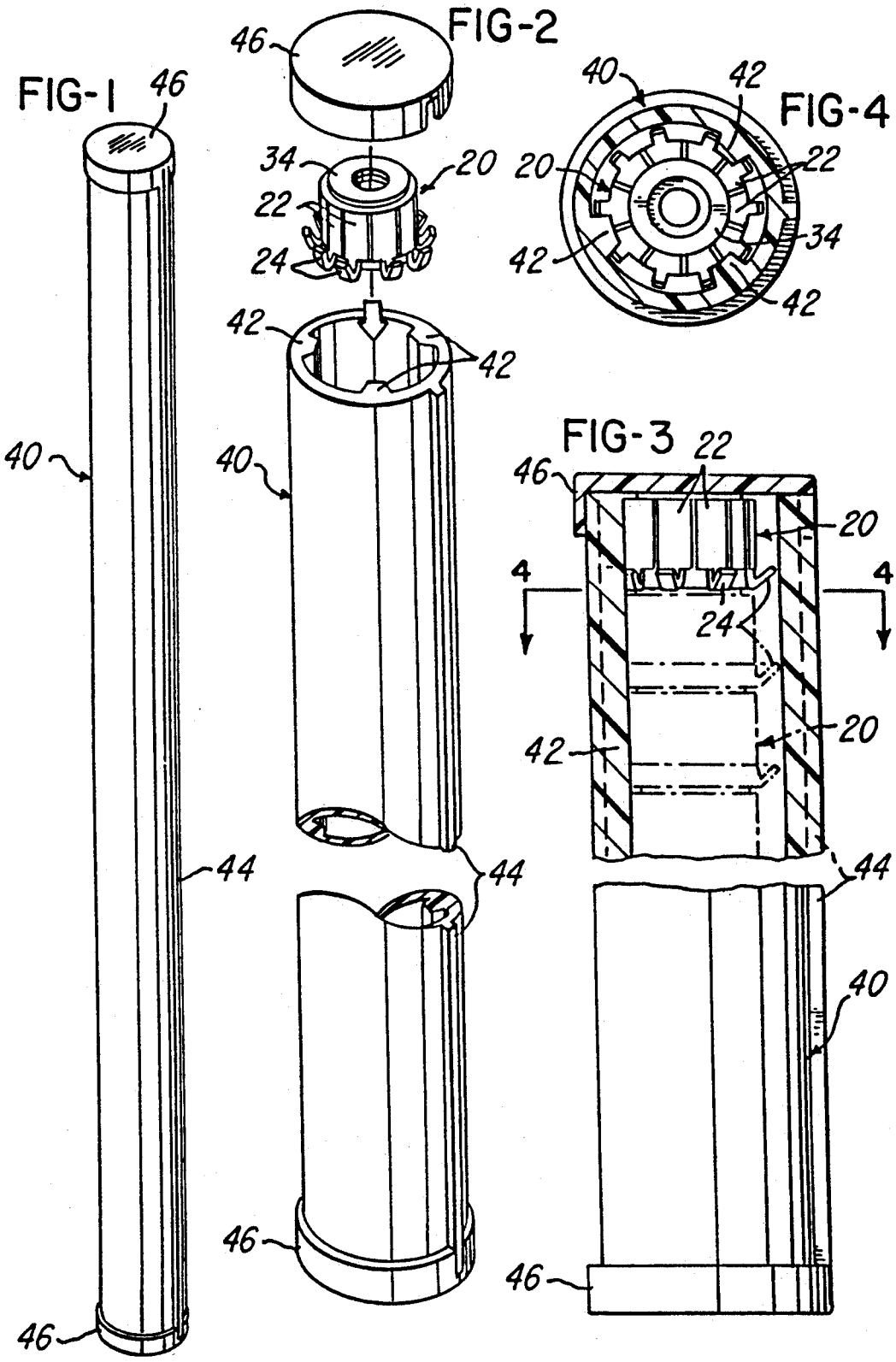
FIG. 1 is a perspective view of a commutator supply tube in accordance with this invention.
FIG. 2 is an enlarged, fragmentary, perspective, partly exploded view, of the commutator supply tube of FIG. 1 showing a commutator being inserted therein.
FIG. 3 is a side elevational view, drawn on a larger scale than FIG. 2, with parts broken away and parts in cross-section, showing the commutator supply tube in a fully commutator-loaded condition.
FIG. 4 is a cross-sectional view of the commutator supply tube taken on line 4—4 of FIG. 3.
Figure 5:
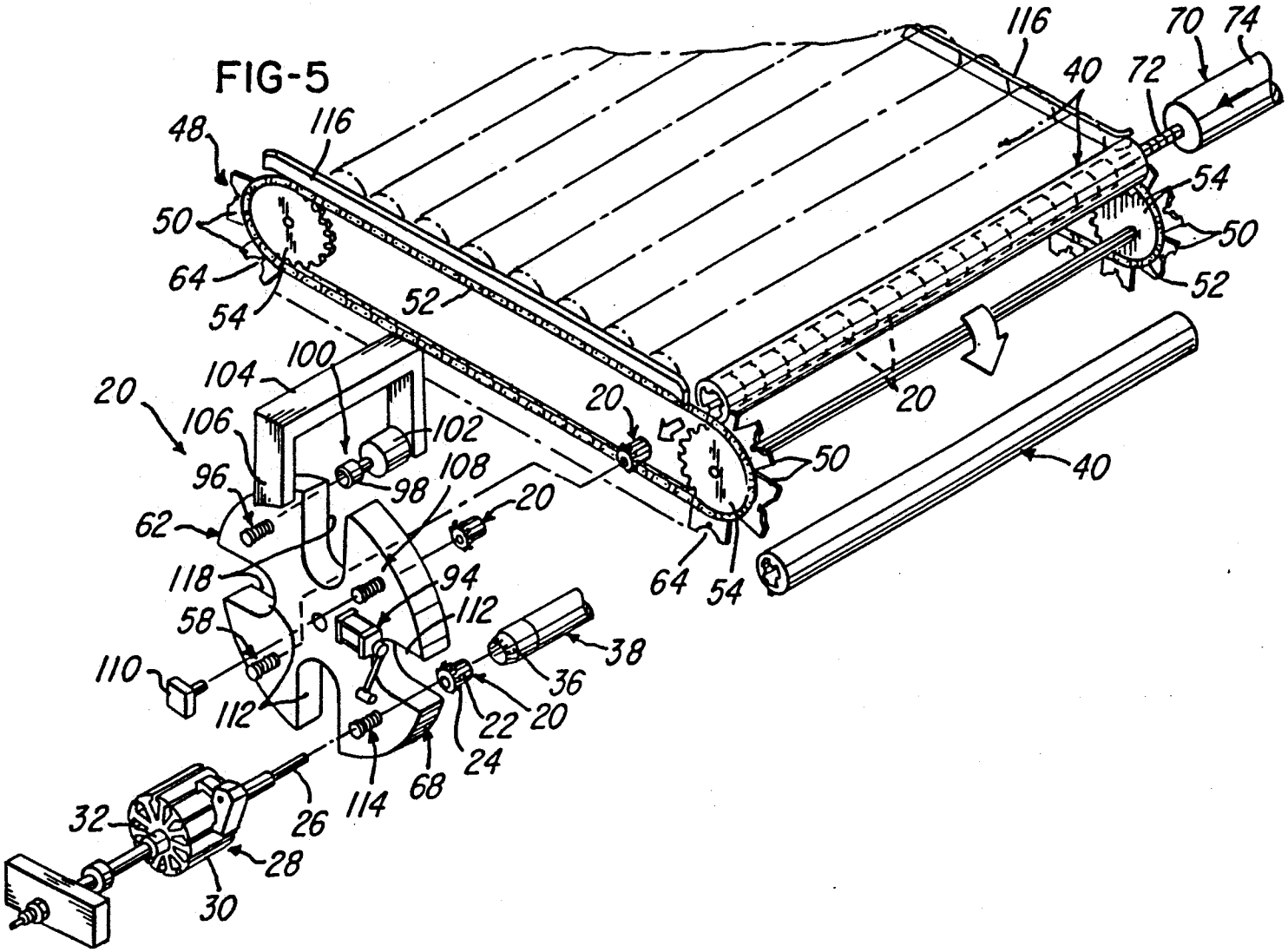
FIG. 5 is a partly diagrammatic, fragmentary, perspective, exploded view of a commutator placing apparatus made in accordance with this invention.
Figure 7:
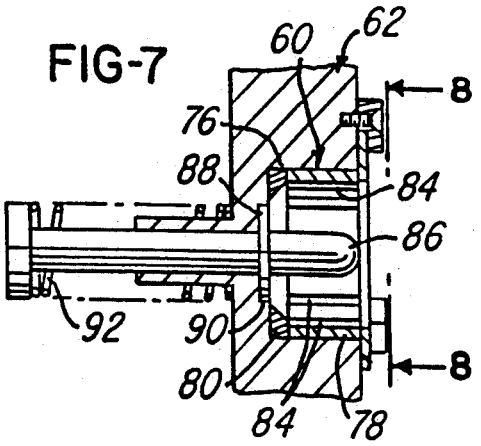
FIG. 7 is an enlarged, fragmentary, cross-sectional view, taken generally on line 7—7 of FIG. 6 showing a fragment of a commutator feed plate with a commutator-receiving nest therein and a spring-loaded ejection pin.

With reference to FIGS. 2 and 5, this invention provides a method and apparatus for placing a commutator 20 having plural bars 22 with coil lead-receiving hooks or tangs 24 onto an armature shaft 26 of an armature core subassembly, generally designated 28, comprising the shaft 26 and a laminated armature core 30 pressed onto the shaft 26, and appropriate insulating sleeves or coatings 32. The armature core 30 has plural, circumferentially spaced, radially extending, and outwardly open coil-receiving slots between radially extending core teeth.

The commutator bars 22 are mounted on a cylindrical body 34 of insulating material, such as plastic, having a through-bore with a diameter sized to be press-fit onto the armature shaft 26. Said Banner et al '631 patent describes the parts of the armature in greater detail.

With reference to FIG. 5, an armature core subassembly 28 to be assembled with a commutator 20 is held by a clamp assembly, such as assembly 48 illustrated in said Banner et al '631 patent, in a predetermined axial and angular position. A commutator 20 to be placed onto the armature shaft is held in the nosepiece, designated 36, of a commutator ram assembly 38. Ram assembly 38 could be the same, for example, as the ram assembly 80 disclosed in said Banner et al '631 patent and the details of its construction and operation are not pertinent to the present invention except to the extent that the ram assembly 38 moves back and forth along the axis of an armature core subassembly 28 positioned to receive a commutator 20 held by the ram nosepiece 36.

The present invention is primarily concerned with the manner in which the commutators 20 are delivered to the ram nosepiece 36. With reference to FIGS. 1 through 4, in accordance with this invention, a plurality of commutators 20 are inserted into a commutator supply tube 40 in end-to-end relationship to form a row of commutators mutually aligned along a common axis coincident with the longitudinal axis of the supply tube 40. The supply tube 40 preferably comprises a straight, rigid, elongate, hollow, cylindrical, plastic body having a cylindrical inner surface provided with plural, longitudinally-extending internal keys 42 along its inner surface that are formed to snugly interfit between adjacent commutator tangs thereby to obtain and maintain a predetermined angular orientation of the commutators. A longitudinally-extending, external rib or key 44, or some other external surface configuration is provided to enable the angular orientation of the tube 40 about its own longitudinal axis. Tube 40 preferably comprises a plastic extrusion.

The commutators 20 may be inserted into the tube 40 by the manufacturer of the commutators after final inspection. Optionally, the commutators 20 may be inserted into the tube 40 after receipt and inspection of the commutators 20 by the armature manufacturer. In either case, the commutators 20 are housed in the tube 40 and secured thereby against damage during handling and transport. The tube 40 is preferably closed at its ends or at least partly closed by end caps 46 or other suitable means, such as tape strips (not shown).

Plural identical commutator supply tubes 40 are preferably provided so that, as each of the tubes 40 is emptied of commutators 20, as will be described below, it can be immediately replaced by another tube 40 filled with commutators 20 whereupon subsequent processing operations may progress without interruption.

Figure 6:
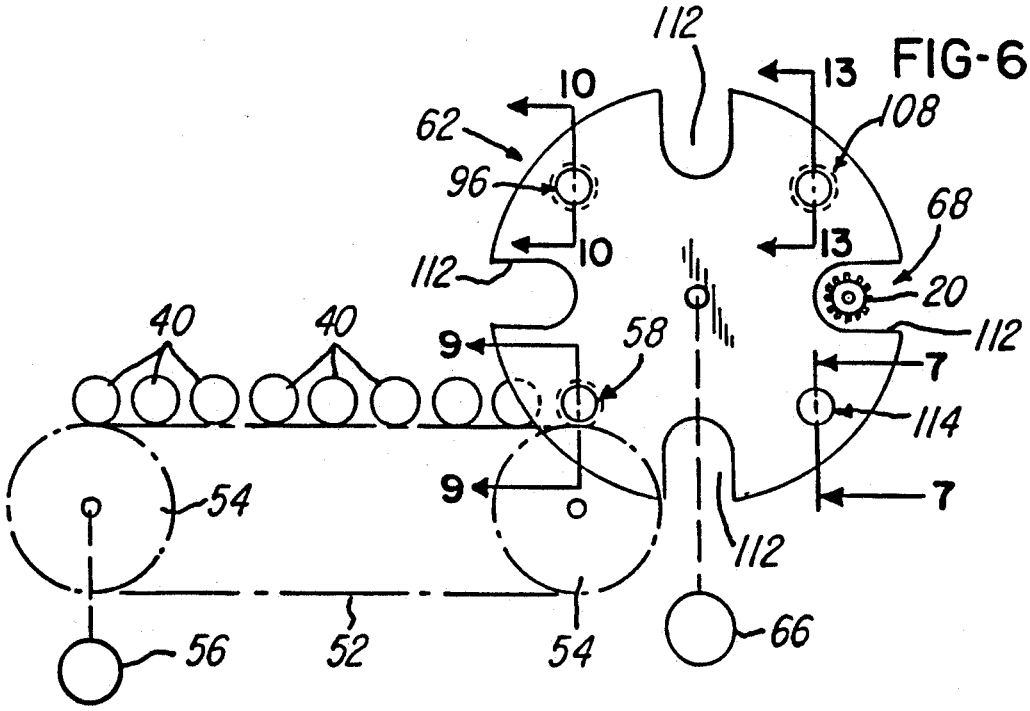
FIG. 6 is a diagrammatic view of a portion of the apparatus of FIG. 5.

With reference to FIGS. 5 and 6, the tubes 40 are preferably conveyed to the immediate area of the commutator placing machine by a conveyor, generally designated 48, having plural seats 50 mounted on a pair of conveyor chains 52 coursed over pairs of sprockets 54 incrementally driven by a suitable drive motor 56. The seats 50 are arranged to support the tubes 40 in a horizontal orientation and convey the tubes 40 successively to a nest-loading station 58, at which the commutators 20 are, one-by-one, transferred from the tube 40 into a commutator-receiving nest 60 (shown in FIGS. 7 through 14) located on a commutator feed plate, generally designated 62. Each conveyor seat 50 is provided with a keyway 64 adapted to interfit with the external keys 44 on the tubes to obtain and maintain the desired orientation of the tubes 40 on the conveyor 48 and thereby the desired angular orientation of the commutators 20.

With continued reference to FIGS. 5 and 6, the commutator feed plate 62 comprises a rigid, generally circular body mounted in any suitable manner for rotation about a horizontal axis, this axis being parallel to the axis of the commutator supply tube 40 at the nest-loading station 58 and also parallel to the axis of movement of the ram 38. In operation, a drive motor 66 (FIG. 6) intermittently indexes the feed plate 62 through 45 degree increments for reasons which will be discussed below. The feed plate 62 has four equally circumferentially-spaced commutator-receiving nests 60 that are successively intermittently moved by rotation of the feed plate 62 from the nest-loading station 58, where a commutator 20 is loaded into a nest 60, to the ram nosepiece loading station 68, where the commutator is removed from the nest 60. The empty nest 60 is then returned to the nest-loading station 58.

An empty nest 60 at the nest loading station is supplied with a commutator 20 by means of a commutator pushing mechanism 70 which pushes on the commutators 20 at one end of the row of aligned commutators 20 within the tube 40 aligned with the empty nest 60. Although other devices may be used, the presently preferred pushing mechanism 70 comprises a threaded screw 72 driven incrementally by a drive motor 74. The length of each movement of the screw 72 is just sufficient to push a commutator 20 at the other end of the tube 40 into the empty nest 60. The screw 72 may then be retracted by a few thousandths of an inch so as to avoid prematurely pushing another commutator 20 out of the tube 40.

The removal of commutators 20 from the supply tube 40 at the nest loading station 58 continues until the tube 20 is emptied. The screw 72 is then retracted from the empty tube 40 and the conveyor 48, which is inactive until the tube 40 is emptied, then operates to move the next supply tube 40 in line into the nest-loading station 58. In consequence, the empty supply tube 40 falls off the end of the conveyor 48, as indicated by the arrow in FIG. 5, into a suitable receptacle (not shown) and is either discarded or reused.

As shown in FIGS. 7 through 14, each nest 60 comprises a bore 76 in the front face of the feed plate 62 forming a cavity which receives a cylindrical sleeve 78 that abuts a bevelled tang back-up ring 80 located in the base of the bore 76. Sleeve 78 may be held within the bore 76 by retainer plates 82 affixed to the front face of the feed plate 62. This construction enables the back-up ring 80 and the sleeve 78 to be removed and replaced if desired to effect a changeover for handling a commutator having differing dimensions. Suitable surfaces (not shown) on the sleeve 78 and the back-up ring 80 are formed to interfit with mating surfaces (not shown) on the bore 76 to hold the sleeve 78 and the ring 80 in a predetermined orientation.

Figure 8:
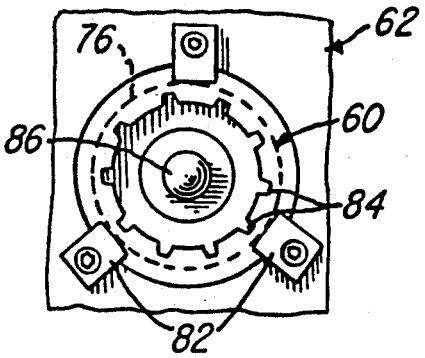
FIG. 8 is a fragmentary front elevational view of the feed plate taken on line 8—8 of FIG. 7.
Figure 9:
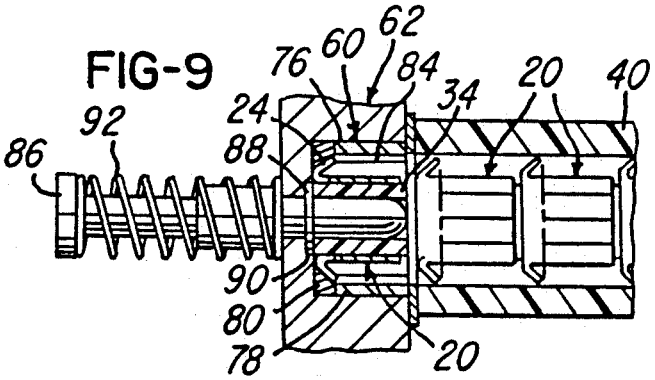
FIG. 9 is a fragmentary, cross-sectional view of the feed plate similar to FIG. 7 taken on line 9—9 of FIG. 6, and a portion of a commutator supply tube at a nest-loading station.

As shown best in FIG. 8, the inner surface of the sleeve is provided with plural, longitudinally-extending grooves 84 that are adapted to receive the outermost tips of the commutator tangs 24. The depth of each groove 84 is exaggerated in FIG. 8 and could be on the order of 0.020 inch or so.

Figure 14:
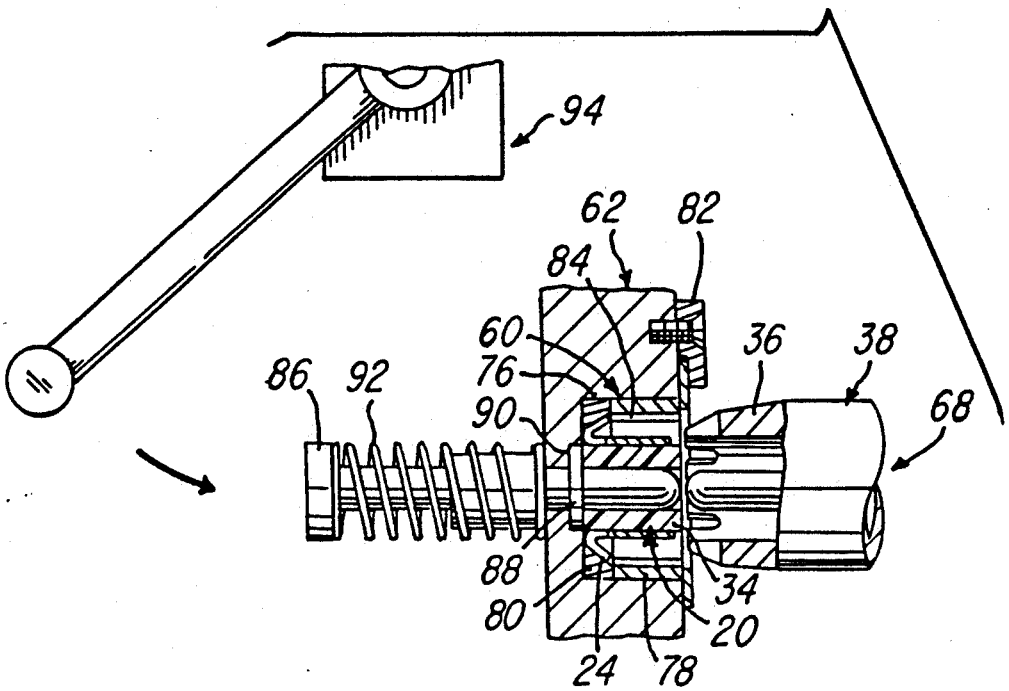
FIG. 14 is a fragmentary, cross-sectional view similar to FIGS. 7, 9, 10 and 13, illustrating a ram nosepiece-loading operation.

Each nest 60 further includes a center commutator ejection pin 86 that extends centrally into the commutator-receiving cavity 76 within the nest 60 and also projects rearwardly through the back of the feed plate 62. A commutator back-up washer 88 encircling and connected to the ejection pin 86 is adapted to fit within a counterbore 90 at the base of the nest cavity 76 and is held therein by a spring 92 coiled about the rear of the pin 86, as is evident from an inspection of FIGS. 7 and 14. However, when a nest 60 reaches the ram loading station 68, the commutator 20 within the nest 60 is pushed out of the nest 60 and into the ram nosepiece 36 as shown in FIGS. 14 by operation of a rotary actuator 94 which causes the back-up washer 88 to engage and move the plastic body 34 of the commutator 20. During this time, the rotary position of the commutator 20 is maintained by virtue of the tangs 24 sliding along the grooves 84 in the sleeve 78. As the tangs 24 begin to move away from the ambit of the grooves 84, they become guided by the ram nosepiece 36 so that the commutator 20 is automatically properly angularly oriented as it enters the nosepiece 36.

Figure 10:
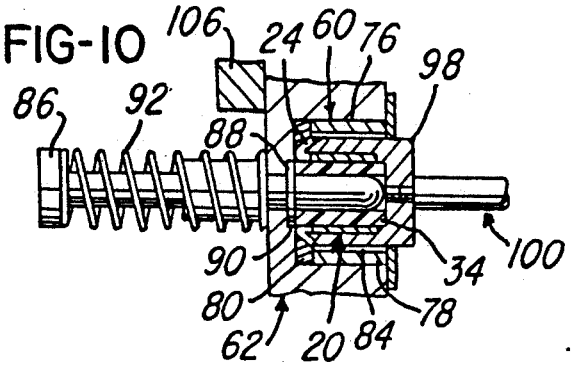
FIG. 10 is a fragmentary, cross-sectional view similar to FIGS. 8 and 9, taken on line 10—10 of FIG. 6, and illustrating a commutator tang forming operation.
Figure 11:
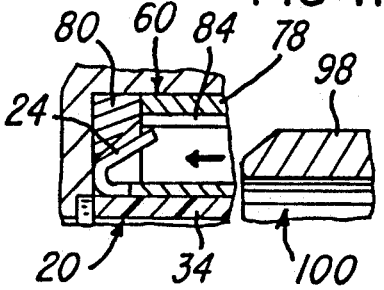
FIGS. 11 and 12 are fragmentary, cross-sectional views illustrating a tang-forming operation.
Figure 12:
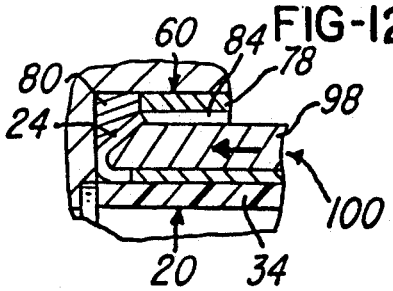
Figure 13:
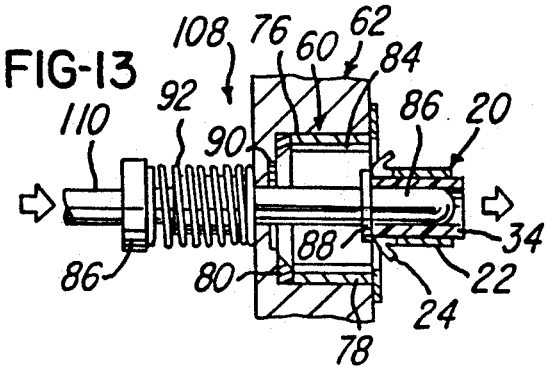
FIG. 13 is a fragmentary, cross-sectional view similar to FIGS. 7, 9 and 10, taken on line 13—13 of FIG. 6, illustrating a commutator-reject operation.

A tang forming station 96 is preferably provided between the nest loading station 58 and the ram loading station 68 at which a tang lifting sleeve 98 is pressed into the nest 60 as shown in FIGS. 10, 11 and 12 to force any lowered tangs outwardly against the back up ring 80 as will be readily understood, by those familiar with the art. Tang lifting sleeve 98 forms part of a tang lifter, generally designated 100, that also includes an actuating cylinder 102 which drives the tang lifting sleeve 98. The tang lifter 100 is mounted on part of the machine frame, designated 104. An anvil or plate back-up member 106 is also mounted on the machine frame 104. Its purpose is to absorb the load placed on the commutator feed plate 62 as the tang lifting sleeve 98 presses against the commutator tangs 24 as shown in FIG. 12. If there is a defect in the commutator 20 at the tang forming station 96 that prevents proper operation of the tang lifter 100, the tang lifter 100 will not be able to bottom out against the tangs 24, an event which can be sensed by a suitable sensor (not shown). A reject station 108 is accordingly provided intermediate the tang forming station 96 and the ram loading station 68 at which a reject actuator 110 is provided that presses on the ejection pin 86, thereby overcoming the bias of the spring 92 to eject a defective commutator 20. The ejection operation is illustrated in FIG. 13. Here it may be noted that the outer diameter of the portion of the ejection pin 86 within the bore of the commutator 20 may be somewhat smaller than the inner diameter of the commutator bore. The rejection actuator 110 and the spring 92 may operate abruptly to cause the ejection pin 86 to thrust rapidly out and back so that the commutator 20 to be ejected will reliably fall off the end of the ejection pin 86.

Referring again to FIGS. 5 and 6, the commutator feed plate 62 is provided with open windows 112 between adjacent ones of the nests 60. The purpose of the windows 112 is to provide a space for movements of the ram 38 necessary to press the commutators 20 onto the armature shafts 26. In operation, following the progress of one commutator 20, it is loaded into a nest 60 at the nest loading station 58, moved through an arc of 45 degrees to an idle position (located at 9:00 o'clock in FIG. 6), moved through an additional arc of 45 degrees to the tang forming station 96, then moved through an additional 45 degrees to another idle position (located at 12:00 o'clock in FIG. 6), and then by an additional 45 degrees to the reject station 108. If the commutator 20 is defective, it is then rejected by operation of the reject actuator 110. If not, it is moved through an additional 45 degrees into alignment with the ram nosepiece 36, at which time it is loaded into the ram nosepiece 36 by operation of the rotary actuator 94. At this time the operating assemblies at the other stations are idle. Following insertion of the commutator 20 into the ram nosepiece 36, the now empty nest 60 is rotated through an additional 45 degrees past the ram loading station 68 into an idle position 114 at which time the window 112 between the empty nest 60 and the next following nest 60 is aligned with the ram nosepiece 36. At this time, the commutator ram assembly 38 operates to carry out the final commutator placing operation, moving forward and back through the opening provided by the aligned window 112. At the same time, a new commutator 20 is being loaded into the next preceding nest 60, the tang lifter 100 operates and the reject actuator 110 operates if appropriate.

Since each time a commutator supply tube 40 is emptied it can be replaced by a full tube 40, it will be appreciated that the foregoing operations can be repeated for an indefinite period of time. A process in accordance with this invention can be carried out to press a commutator 20 onto an armature shaft 26 every 5 or 6 seconds, a speed competitive with other commutator placing processes.

Any coverings over the ends of the tubes 40 are removed when the tubes 40 are positioned on the conveyor 48. To prevent accidental discharge of commutators 20 from a tube 40 being conveyed by the conveyor 48, the sides of the conveyor 48 may be provided with guard rails 116 close to each end of the row of tubes 40 progressing along the conveyor. To preclude the possibility that a commutator 20 at the end of the tube 40 located in the nest-loading station 58 might accidentally protrude from the end of the tube 40 and strike against the trailing edge of a window 112, the trailing window edges may be bevelled, as indicated at 118, to cam any protruding commutator 20 back into the tube 40 at the nest-loading station 58 as the commutator feed plate 62 swipes therealong.

Although the presently preferred embodiment of this invention has been described, it will be understood that within the purview of the invention various changes may be made within the scope of the following claims.

We claim:

1. For use in supplying commutators to a commutator placing machine, the combination comprising:

an elongate, hollow, cylindrical, commutator supply tube having a longitudinally-extending center axis and configured to hold a plurality of commutators in end-to-end relationship, tube-alignment means on the outside surface of said tube for releasably engaging tube handling mechanisms associated with a commutator delivering apparatus so that said tube is located on said delivering apparatus with said tube alignment surfaces in a predetermined angular orientation with respect to said center axis, and commutator guide means on said tube for orienting commutators housed within said tube in a predetermined angular orientation with respect to said tube-alignment means so that commutators may be supplied in said tube to a commutator placing machine in a predetermined angular orientation;

a row of commutators angularly oriented by said guide means substantially filling said tube and aligned end-to-end substantially along said center axis; and means for at least partly covering the ends of said tube.

2. A combination according to claim 1 wherein said commutator guide means comprises longitudinally-extending internal keys positioned along the inner surface of said commutator supply tube.

3. A combination according to claim 1 wherein said tube-alignment means comprises a longitudinally-extending projection that extends outwardly from said outside surface.

4. A combination according to claim 1 wherein said closing means comprises a pair of end caps.

5. A combination according to claim 1 wherein said closing means comprises tape strips over the ends of said tube.

6. A combination according to claim 1 wherein said commutator supply tube comprises a plastic extrusion.

7. A combination according to claim 1 wherein said commutator guide means comprises longitudinally-extending internal keys positioned along the inner surface of said commutator supply tube, and wherein said tube-alignment means comprises a longitudinally-extending projection that extends outwardly from said outside surface.

8. A combination according to claim 7 wherein said closing means comprises a pair of end caps.

9. A combination according to claim 7 wherein said closing means comprises tape strips over the ends of said tube.

10. A combination according to claim 7 wherein said commutator supply tube comprises a plastic extrusion.

* * * * *